US008508451B2

(12) United States Patent
Pan et al.

(10) Patent No.: US 8,508,451 B2
(45) Date of Patent: Aug. 13, 2013

(54) DISPLAY APPARATUS AND METHOD FOR DRIVING DISPLAY PANEL THEREOF

(75) Inventors: Hsuan-Lin Pan, Tao-Yuan Hsien (TW); Chien-Yung Cheng, Tao-Yuan Hsien (TW)

(73) Assignee: Hannstar Display Corporation, New Taipei (TW)

( * ) Notice: Subject to any disclaimer, the term of this patent is extended or adjusted under 35 U.S.C. 154(b) by 859 days.

(21) Appl. No.: 12/017,345

(22) Filed: Jan. 22, 2008

(65) Prior Publication Data

US 2009/0109132 A1 Apr. 30, 2009

(30) Foreign Application Priority Data

Oct. 31, 2007 (TW) ..... 96141070 A

(51) Int. Cl.
*G09G 3/36* (2006.01)

(52) U.S. Cl.
USPC ..... 345/94

(58) Field of Classification Search
USPC ..... 345/87–104
See application file for complete search history.

(56) References Cited

U.S. PATENT DOCUMENTS

| | | | | |
|---|---|---|---|---|
| 5,883,609 | A * | 3/1999 | Asada et al. | 345/100 |
| 2002/0105490 | A1* | 8/2002 | Kanbe et al. | 345/87 |
| 2003/0145336 | A1* | 7/2003 | Matsuzaki et al. | 725/136 |
| 2003/0193461 | A1* | 10/2003 | Katagawa | 345/87 |
| 2003/0210215 | A1* | 11/2003 | Takahashi | 345/87 |
| 2004/0150605 | A1* | 8/2004 | Arimoto et al. | 345/100 |
| 2004/0155848 | A1* | 8/2004 | Kudo et al. | 345/89 |
| 2004/0201786 | A1* | 10/2004 | Park et al. | 349/12 |
| 2004/0212577 | A1* | 10/2004 | Takeda et al. | 345/99 |
| 2004/0222943 | A1* | 11/2004 | Kudo et al. | 345/1.1 |
| 2006/0007217 | A1* | 1/2006 | Kanbe et al. | 345/204 |
| 2006/0176266 | A1 | 8/2006 | Pak et al. | |
| 2007/0120811 | A1* | 5/2007 | Kudo et al. | 345/103 |
| 2007/0206106 | A1* | 9/2007 | Kakumoto et al. | 348/308 |
| 2007/0229436 | A1* | 10/2007 | Sun | 345/98 |
| 2007/0262943 | A1* | 11/2007 | Kang | 345/98 |
| 2008/0074371 | A1* | 3/2008 | Tajiri | 345/89 |
| 2008/0143659 | A1* | 6/2008 | Ma | 345/87 |

FOREIGN PATENT DOCUMENTS

| | | |
|---|---|---|
| TW | 200421156 | 10/2004 |
| TW | 200632813 | 9/2006 |
| TW | I286634 | 9/2007 |

OTHER PUBLICATIONS

"Office Action of Taiwan Counterpart Application", issued on Feb. 7, 2012, p. 1-p. 8.
"Second Office Action of China Counterpart Application", issued on Feb. 21, 2012, p. 1-p. 4.

* cited by examiner

*Primary Examiner* — Chanh Nguyen
*Assistant Examiner* — Sanghyuk Park
(74) *Attorney, Agent, or Firm* — Jianq Chyun IP Office

(57) ABSTRACT

A display apparatus and a method for driving a display panel thereof are provided. The display panel includes an inducing signal readout line and N gate lines, in which N is a natural number. The inducing signal readout line is coupled to a plurality of inducing circuits. Each inducing circuit is coupled to one of the gate lines, and the $N^{th}$ gate line is coupled to one of the inducing circuits. In the method, several gate pulses are provided to drive the gate lines sequentially to turn on the corresponding inducing circuits, wherein at least a portion of the driving duration of a gate pulse provided to the $N^{th}$ gate line is in a blanking time between two frames.

15 Claims, 9 Drawing Sheets

DISPLAY APPARATUS AND METHOD FOR DRIVING DISPLAY PANEL THEREOF

CROSS-REFERENCE TO RELATED APPLICATION

This application claims the priority benefit of Taiwan application serial no. 96141070, filed on Oct. 31, 2007. The entirety of the above-mentioned patent application is hereby incorporated by reference herein and made a part of this specification.

BACKGROUND OF THE INVENTION

1. Field of the Invention

The present invention relates to a display apparatus and a method for driving a display panel thereof. More particularly, the present invention relates to a display apparatus having more uniform induction sensitivity and a method for driving a display panel thereof.

2. Description of Related Art

Among different types of input panel products, an input panel with a sensing film will have a higher cost and a lower transmittance reduced by about 20%. While in embedded input panels, inducing circuits capable of sensing touches are designed depending on characteristics of amorphous-Si, and integrated into a thin film transistor (TFT) array process of a thin film transistor-liquid crystal display (referred to as TFT-LCD). By comparison, embedded input panels have the advantages of low cost and better optical properties, so they have gradually replaced the input panels with a sensing film.

In the design of the embedded input panels, the inducing circuits are added on the original pixel layout of the display panel, so the functions of the inducing circuits must be ensured while not affecting the original optical properties. In other words, the inducing circuits must be compatible with the original panel design, thereby maintaining the display quality and realizing the input function. FIG. 1 is a schematic view of a configuration of inducing circuits of a conventional embedded input panel and gate line signals thereof. Referring to FIG. 1, a display panel is denoted by 100. Inducing circuits are denoted by 102. Gate lines are denoted by $G_1$-$G_N$. Inducing signal readout lines are denoted by $R_1$-$R_M$. A signal processing circuit is denoted by 104. Gate line signals of the gate lines $G_1$-$G_N$ are denoted by $SG_1$-$SG_N$. A gate pulse is denoted by 106. A blanking time between two frames is denoted by $T_B$, which will be described below.

Referring to FIG. 1 again, the inducing circuits 102 in FIG. 1 are disposed according to the arrangement of the original pixels (not shown), so the inducing circuits 102 are also referred to as pixel inducing circuits. In FIG. 1, each pixel works together with one inducing circuit 102, and each inducing circuit 102 is coupled to one of the gate lines and one of the inducing signal readout lines. The inducing circuits 102 output an inducing signal to the inducing signal readout lines once receiving a gate pulse, such that the signal processing circuit 104 processes the readout inducing signal.

Generally speaking, the inducing circuits 102 may be realized by two circuit structures respectively as shown in FIG. 2 and FIG. 3. FIG. 2 shows a common charge inducing circuit. Referring to FIG. 2, the charge inducing circuit is denoted by 200. The bias is denoted by $V_B$. The inducing signal readout line is denoted by $R_X$. The gate line is denoted by $G_X$. The charge inducing circuit 200 consists of a TFT 202 for sensing, a TFT 204 serving as a switch, and capacitors 206-210. FIG. 3 shows a common current inducing circuit. Referring to FIG. 3, the current inducing circuit is denoted by 300. The bias is denoted by $V_B$. The inducing signal readout line is denoted by $R_X$. The gate line is denoted by $G_X$. The current inducing circuit 300 consists of a TFT 302 for sensing, a TFT 304 serving as a switch, and capacitors 306-310.

Referring to FIG. 1 again, it can be known from the gate pulse timing in FIG. 1 that in each frame, gate lines in the display panel 100 are sequentially driven in the manner of gate lines $G_1$-$G_N$. Between two adjacent frames, in a short time period, no gate pulse drives the gate lines, which is the previously mentioned blanking time $T_B$. In other words, the blanking time $T_B$ can be defined as the time between after the last driven gate line signal $SG_N$ closed of the first frame and before the first driven gate line signal $SG_1$ opened of the second frame, the first frame and the second frame are adjacent frames. During the blanking time $T_B$, as all the gate line signals $SG_1$-$SG_N$ are in a low voltage level state, the voltage level of the inducing signal are greatly changed, and thus the induction sensitivity of the embedded input panel may be non-uniform, which will be explained with reference to FIG. 4.

FIG. 4 illustrates a relationship between the inducing signal level and the gate line signals $SG_1$-$SG_N$ on one of the inducing signal readout lines in FIG. 1. Referring to FIG. 4, the inducing signal level on the inducing signal readout line is denoted by $V_{ROUT}$. The $SG_1$-$SG_N$ and symbol $T_B$ denote the same as those in FIG. 1. As the gate pulses of the gate line signals $SG_1$-$SG_N$ are generated at different time, the gate lines $G_1$-$G_N$ are sequentially driven according to the generation sequence of the gate pulses. Since the time difference between driving two adjacent gate lines is extremely small, the inducing signal level $V_{ROUT}$ on the inducing signal readout lines remains substantial constant (here, the constant inducing signal may also be referred to as a background signal). The parts denoted by 402 or 404 on the inducing signal level $V_{ROUT}$ reflect that the inducing circuits 102 senses an input signal.

During the blanking time $T_B$, although the gate line signals $SG_1$-$SG_N$ are in a low level state, a current leakage of the inducing circuits 102 occurs, such that the inducing signal level $V_{ROUT}$ is lowered. When the next frame starts, the inducing signal level $V_{ROUT}$ is gradually raised to a normal state once again because the gate lines $G_1$-$G_N$ is sequentially driven. However, in the course of raising the level once again, if the inputs from the user happen again, the input signals as shown by 406 or 408, as the inducing signal level $V_{ROUT}$ has not returned to the normal state yet, the identification accuracy of the first several gate lines of the next frame when turning on will not be influenced, thus degrading the induction sensitivity of the top portion of the embedded input panel. In this manner, the overall induction sensitivity of the embedded input panel is non-uniform.

SUMMARY OF THE INVENTION

Accordingly, the present invention is directed to a method for driving a display panel, which can prevent the non-uniform induction sensitivity of the display panel.

The present invention is further directed to a display apparatus, which has uniform induction sensitivity.

As embodied and broadly described herein, the present invention provides a method for driving a display panel in an embodiment. The display panel includes an inducing signal readout line and N gate lines, in which N is a natural number. The inducing signal readout line is coupled to a plurality of inducing circuits. Each inducing circuit is coupled to one of the gate lines. An $N^{th}$ gate line is coupled to one of the inducing circuits. In the method, several gate pulses are provided to drive the gate lines sequentially to turn on the corresponding inducing circuits, wherein at least a portion of the driving duration of a gate pulse provided to the $N^{th}$ gate line is in a blanking time between two frames.

As embodied and broadly described herein, the present invention further provides a method for driving a display panel in another embodiment. The display panel includes an inducing signal readout line, N gate lines, and a dummy gate line, in which N is a natural number. The inducing signal readout line is coupled to a plurality of inducing circuits. Each inducing circuit is coupled to one of the N gate lines. The dummy gate line is coupled to one of the inducing circuits. In the method, several gate pulses are provided to drive the gate lines sequentially to turn on the corresponding inducing circuit. And an another gate pulse is provided to drive the dummy gate line, wherein at least a portion of the driving duration of the another gate pulse is in a blanking time between two frames.

As embodied and broadly described herein, the present invention further provides a display apparatus in another embodiment. The display apparatus includes a display panel and a gate driver. The display panel includes N gate lines, an inducing signal readout line, and a plurality of inducing circuits, in which N is a natural number. Each inducing circuit is coupled to the inducing signal readout line and is coupled to one of the gate lines. An $N^{th}$ gate line is coupled to one of the inducing circuits. The gate driver drives the gate lines sequentially by providing several gate pulses to the gate lines, so as to turn on the corresponding inducing circuits through the gate lines. Wherein, at least a portion of the driving duration of a first gate pulse provided to the $N^{th}$ gate line is in a blanking time between two frames.

As embodied and broadly described herein, the present invention provides a display apparatus in another embodiment. The display apparatus includes a display panel and a gate driver. The display panel includes N gate lines, a dummy gate line, an inducing signal readout line, and a plurality of inducing circuits, in which N is a natural number. Each inducing circuit is coupled to the inducing signal readout line and is coupled to one of the N gate lines. The dummy gate line is coupled to one of the inducing circuits. The gate driver drives the N gate lines sequentially by providing several gate pulses to the N gate lines, so as to turn on the corresponding inducing circuits through the gate lines. And the gate driver further drives the dummy gate line by providing an another gate pulse to the dummy gate line, wherein at least a portion of the driving duration of the another gate pulse is in a blanking time between two frames.

As embodied and broadly described herein, the present invention provides a method for driving a display panel in still another embodiment. The display panel includes an inducing signal readout line and N gate lines, in which N is a natural number. The inducing signal readout line is coupled to a plurality of inducing circuits. Each inducing circuit is coupled to one of the gate lines. In the method, several gate pulses are provided to driving the gate lines sequentially to turn on the corresponding inducing circuits. And an another gate pulse is provided to drive one of the gate lines again, wherein the gate line that is driven again is coupled to one of the inducing circuit and at least a portion of the driving duration of the another gate pulse is in a blanking time between two frames.

In order to make the aforementioned and other objects, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
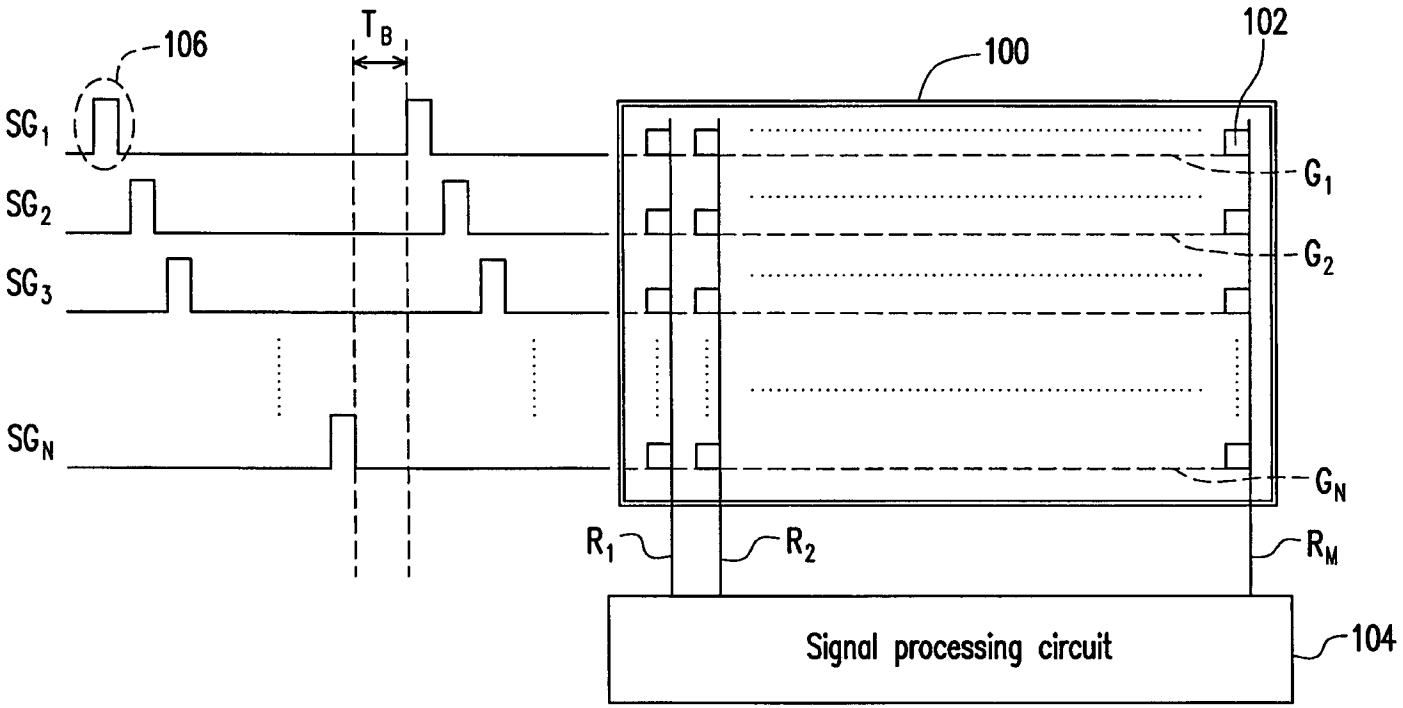
FIG. 1 (PRIOR ART)
FIG. 1 is a schematic view of a configuration of inducing circuits of a conventional embedded input panel and gate line signals thereof.
Figure 3:
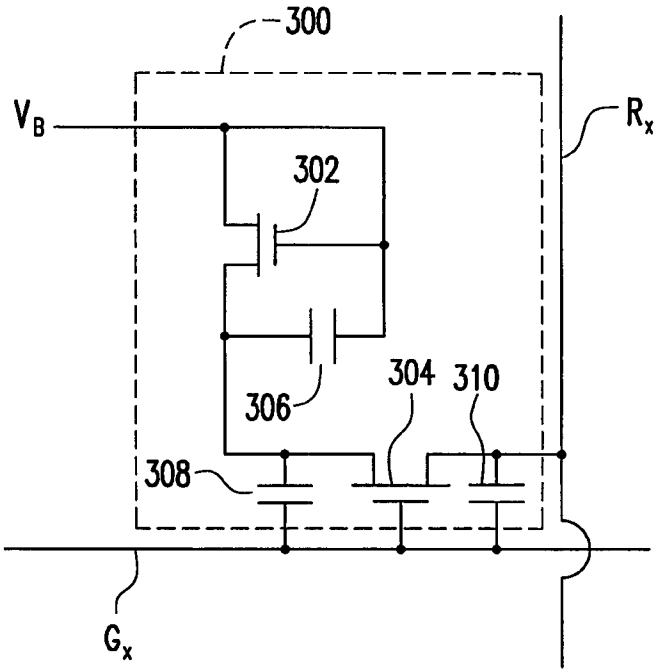
FIG. 3 (PRIOR ART)
FIG. 3 is a circuit diagram of a common current inducing circuit.
Figure 2:
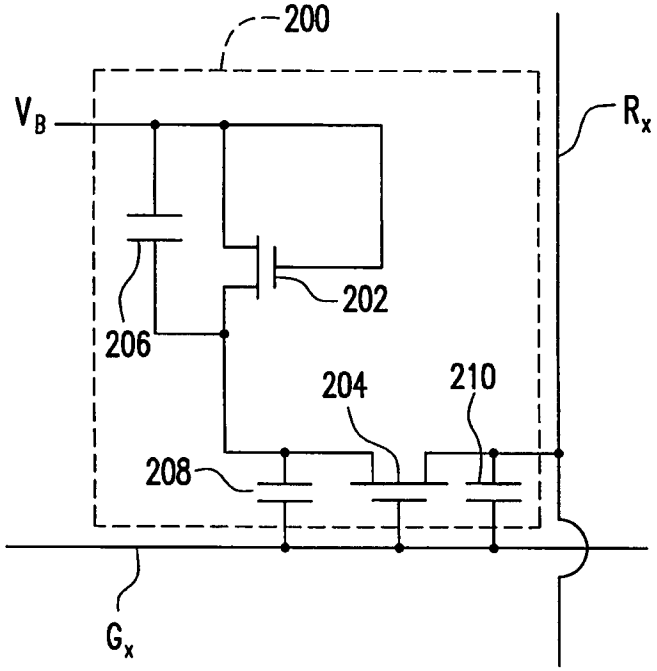
FIG. 2 (PRIOR ART)
FIG. 2 is a circuit diagram of a common charge inducing circuit.
Figure 4:
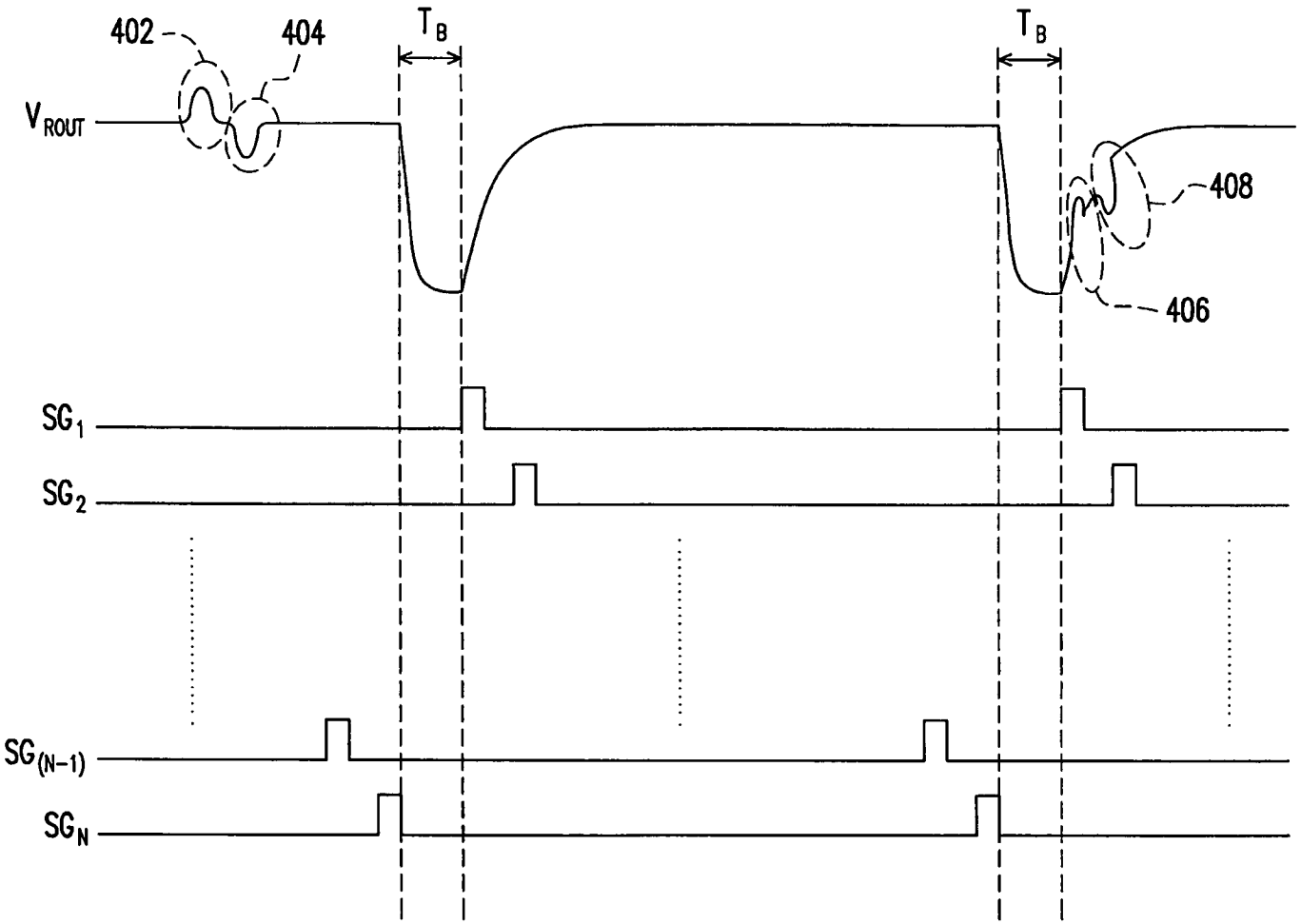
FIG. 4 (PRIOR ART)
FIG. 4 illustrates a relationship between the inducing signal level and the gate line signals $SG_1$-$SG_N$ on one of the inducing signal readout lines in FIG. 1.
Figure 5:
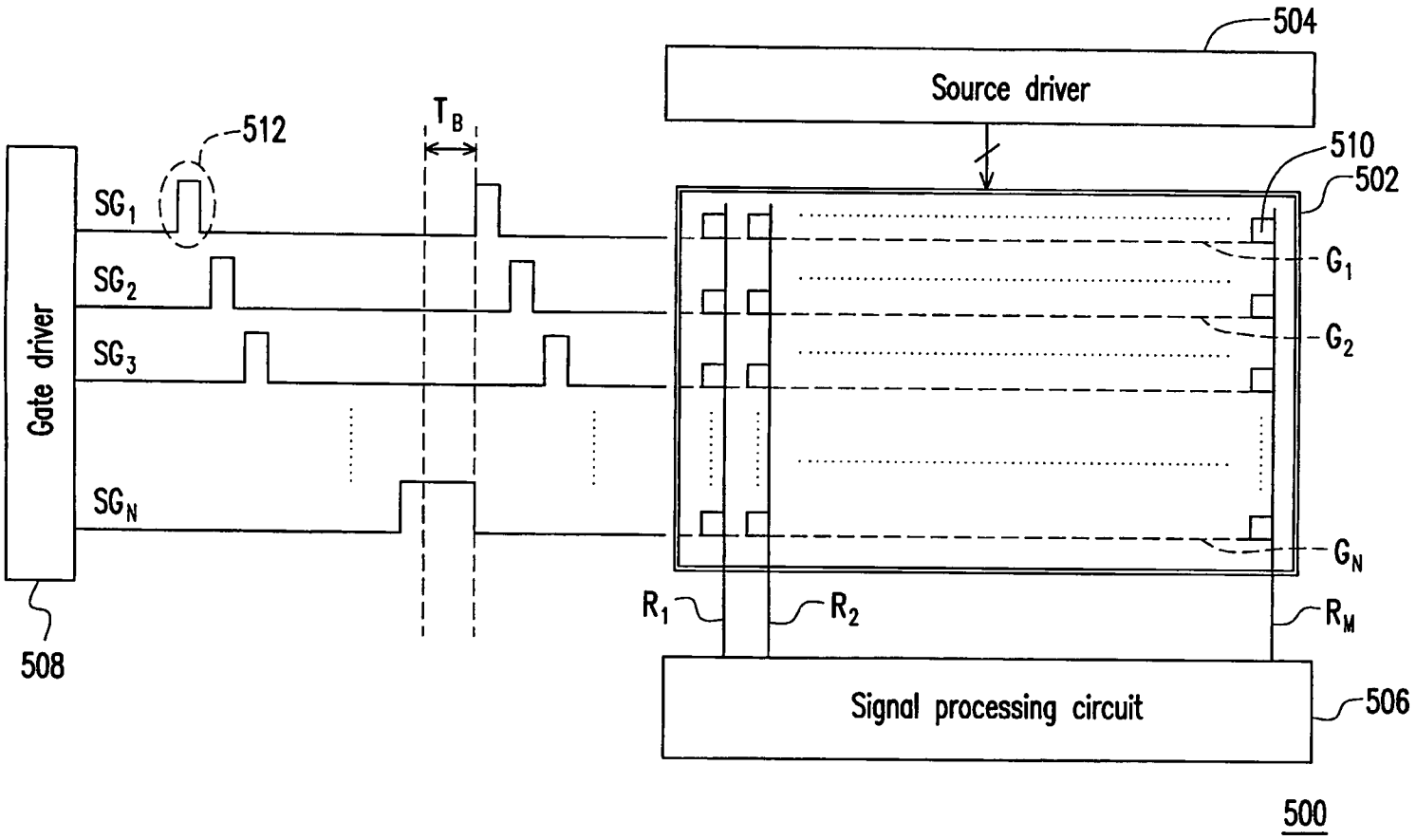
FIG. 5 is a schematic view of a display apparatus and a method for driving a display panel thereof according to an embodiment of the present invention.

FIG. 5 is a schematic view of a display apparatus and a method for driving a display panel thereof according to an embodiment of the present invention. Referring to FIG. 5, the display apparatus is denoted by 500. The display apparatus 500 includes a display panel 502, a source driver 504, a signal processing circuit 506, and a gate driver 508. The display panel 502 includes inducing circuits 510, gate lines $G_1$-$G_N$, and inducing signal readout lines $R_1$-$R_M$. The gate line signals corresponding to the gate line driver 508 output by gate lines $G_1$-$G_N$ are denoted by $SG_1$-$SG_N$. The gate pulse is denoted by 512. The blanking time between two frames is denoted by $T_B$. For easier comparison with the conventional technique, in this embodiment and the following embodiments, the display panel is an embedded input panel, and the inducing circuits are realized by charge inducing circuits (in FIG. 2) or current inducing circuits (in FIG. 3).

Referring to FIG. 5 again, the inducing circuits 510 are disposed according to the arrangement of original pixels (not shown). In this embodiment, each pixel works together with one inducing circuit 510, and each inducing circuit 510 is coupled to one gate line and one inducing signal readout line. The configuration of the inducing circuits 510 may be adjusted according to different resolution requirements, and the inducing circuits 510 may not be in one-to-one correspondence to the pixel. When receiving the gate pulse, the inducing circuits 510 output an inducing signal to the inducing signal readout lines, such that the signal processing circuit 506 processes the readout inducing signal. The source driver 504 provides frame data of the pixel to which each gate line is coupled. It can be known from the gate pulse time in FIG. 5 that in each frame, the gate lines in the display panel 500 are sequentially driven in the manner of gate lines $G_1$-$G_N$, and the driving duration of the gate pulse of the gate line $G_N$ is extended to the blanking time $T_B$ between two frames. In detail, the gate driver 508 drives the gate lines $G_1$-$G_N$ sequentially to turn on the corresponding inducing circuits through the gate lines, and the gate driver 508 extends the driving duration of the gate pulse of the gate line $G_N$ to the blanking time $T_B$ between two frames, so as to turn on the inducing circuits to which the gate line $G_N$ is coupled through the gate line $G_N$ during the blanking time $T_B$. The benefits of this manner will be explained with reference to FIG. 6.

Figure 6:
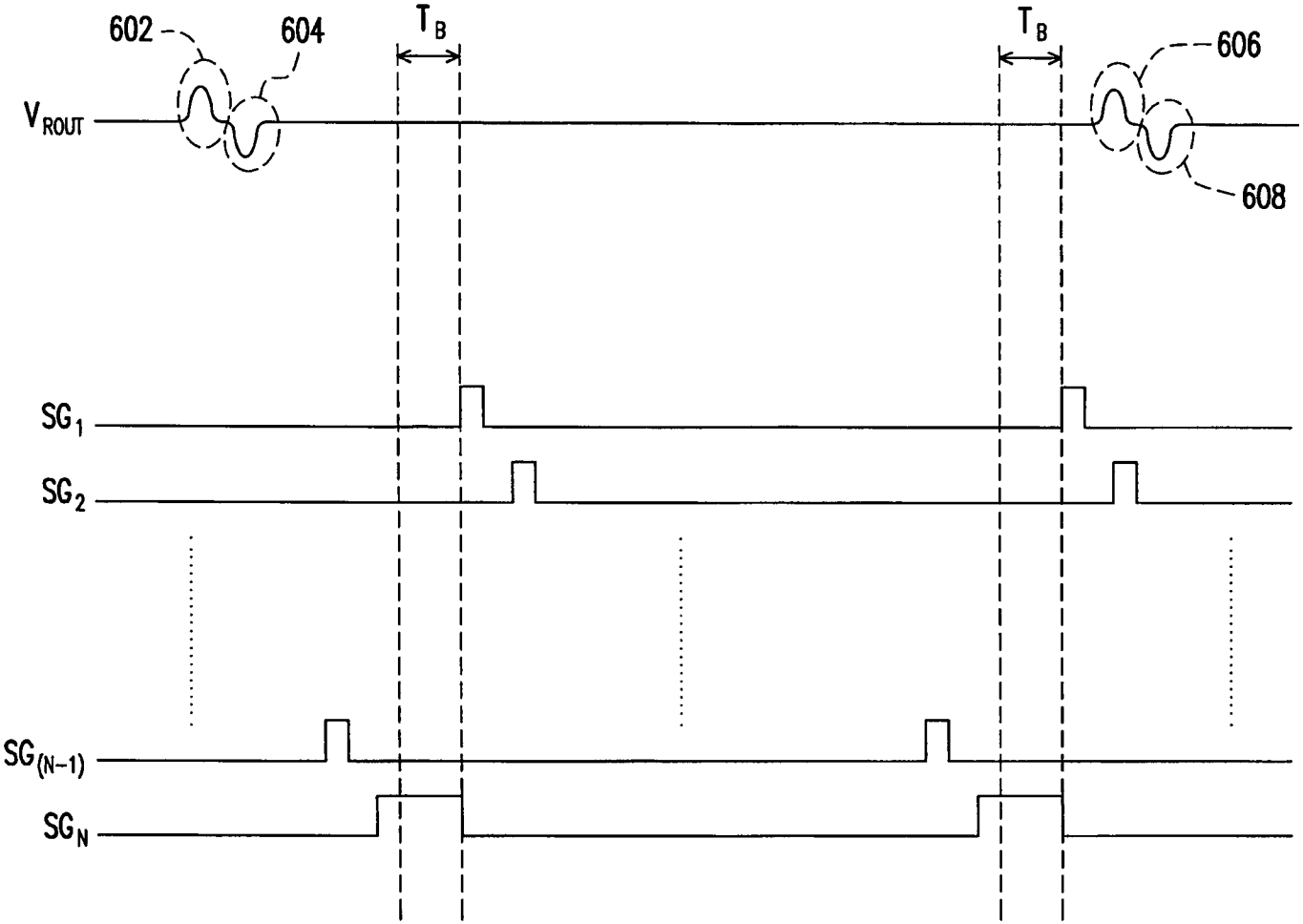
FIG. 6 illustrates a relationship between the inducing signal level and the gate line signals $SG_1$-$SG_N$ on one of the inducing signal readout lines in FIG. 5.

FIG. 6 illustrates a relationship between the inducing signal level and the gate line signals $SG_1$-$SG_N$ on one of the inducing signal readout lines in FIG. 5. Referring to FIG. 6, the inducing signal level on the inducing signal readout line is denoted by $V_{ROUT}$. $SG_1$-$SG_N$ and symbol $T_B$ denote the same as those in FIG. 5. As the gate pulses of the gate line signals $SG_1$-$SG_N$ are generated at different time, the gate lines $G_1$-$G_N$ are sequentially driven according to the generation sequence of the gate pulses. Since the time difference between driving two adjacent gate lines is extremely small, the inducing signal level $V_{ROUT}$ on the inducing signal readout line remains substantial constant. The parts denoted by 602 or 604 on the inducing signal level $V_{ROUT}$ reflect that the inducing circuits 502 senses the input signal.

During the blanking time $T_B$, although the gate line signals $SG_1$-$SG_{N-1}$ are in a low level state, the gate line signal $SG_N$ is in a high level state. Thus, the inducing circuits 510 to which the gate, line $G_N$ is coupled continuously output a constant inducing signal, such that the inducing signal level $V_{ROUT}$ on the inducing signal readout line remains at a stable level (i.e., the background signal is substantially maintained). Therefore, even if the top portion of the display panel 502 receives the input signal 606 or 608 from the user at the very beginning of the frame, the inducing signal level $V_{ROUT}$ remains at a stable level, and thus the identification accuracy of the first several gate lines when turning on will not be influenced. In this manner, the induction sensitivity of the top portion of the display panel 502 will not be reduced, such that the overall induction sensitivity of the panel is more uniform.

Definitely, in order to ensure normal frame display, when the gate driver 508 extends the driving duration of the gate pulse of the gate line $G_N$ to the blanking time $T_B$, the source driver 504 retains the frame data of the pixel to which the gate line $G_N$ is coupled at the blanking time $T_B$. Further, in FIGS. 5 and 6, the driving duration of the gate pulse of the gate line $G_N$ is extended to the driving duration of the adjacent frame. However, it can be deduced from the operations of the above embodiments that, as long as the enable time of the gate pulse on the gate line signal $SG_N$ is long enough to make the inducing signal level $V_{ROUT}$ on the inducing signal readout line remain substantial unchanged, the pulse stop time of the gate pulse on the gate line signal $SG_N$ does not need to be extended to the pulse onset time of the gate pulse on gate line signal $SG_1$ of the next frame. That is, the enable time of the gate pulse on the $SG_N$ may be adjusted flexibly. Or, if the gate lines are sequentially driven in the manner of gate lines $G_N$-$G_1$, the driving duration of the gate line $G_N$ will not be extended to the blanking time $T_B$, but the driving duration of the gate pulse on the gate line signal $SG_1$ is extended to the preceding blanking time $T_B$, or the pulse onset time of the gate pulse on the gate line signal $SG_1$ is advanced to the pulse stop time of gate pulse on the gate line $G_N$. Other operations above-mentioned can also make the overall induction sensitivity of the panel become more uniform. However, in order to ensure normal frame display, the source driver must change output manner of the frame data correspondingly.

Figure 7:
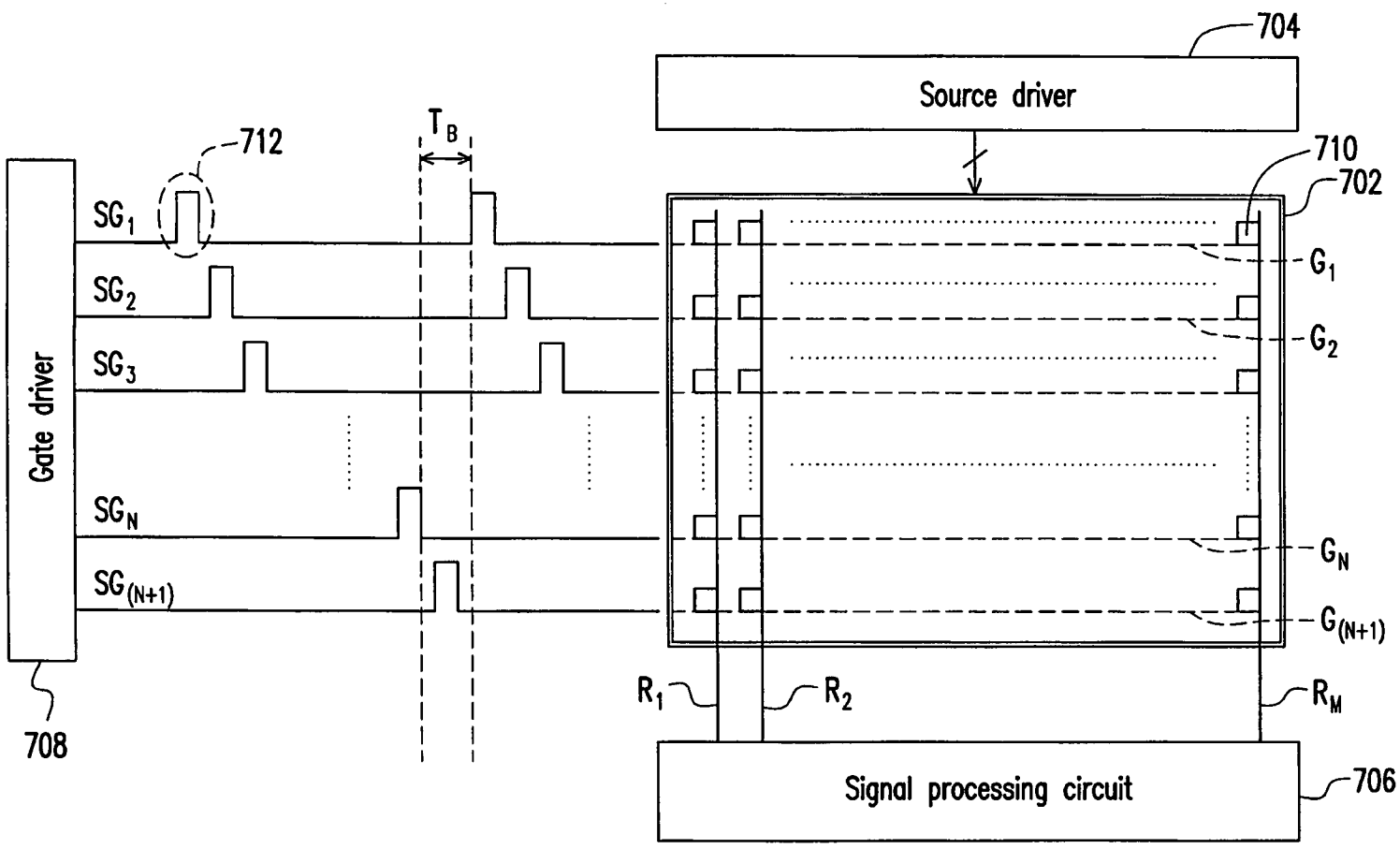
FIG. 7 is a schematic view of a display apparatus and a method for driving a display panel thereof according to another embodiment of the present invention.

Under the concept of the operations of the above embodiments, another solution may be deduced, as shown in FIG. 7. FIG. 7 is a schematic view of a display apparatus and a method for driving a display panel thereof according to another embodiment of the present invention. Referring to FIGS. 7 and 5 together, the difference therebetween is described as follows. The display panel 702 in FIG. 7 further includes a dummy gate line denoted by $G_{(N+1)}$, in addition to the gate lines $G_1$-$G_N$. The dummy gate line $G_{(N+1)}$ is coupled to a plurality of inducing circuits 710. Each inducing circuit 710 is coupled to one of the inducing signal readout lines. Further, a gate driver 708 does not extend the driving duration of the gate line $G_N$ to the blanking time $T_B$, but outputs a gate line signal $SG_{(N+1)}$ corresponding to the dummy gate line $G_{(N+1)}$. In detail, the gate driver 708 sequentially drives the gate lines $G_1$-$G_N$ to turn on the corresponding inducing circuits through the gate lines. The gate driver 708 drives the dummy gate line $G_{(N+1)}$ during the blanking time $T_B$ between two frames, so as to turn on the inducing circuit to which the dummy gate line $G_{(N+1)}$ is coupled through the dummy gate line $G_{(N+1)}$ during the blanking time $T_B$. The benefits of this manner will be explained with reference to FIG. 8.

Figure 8:
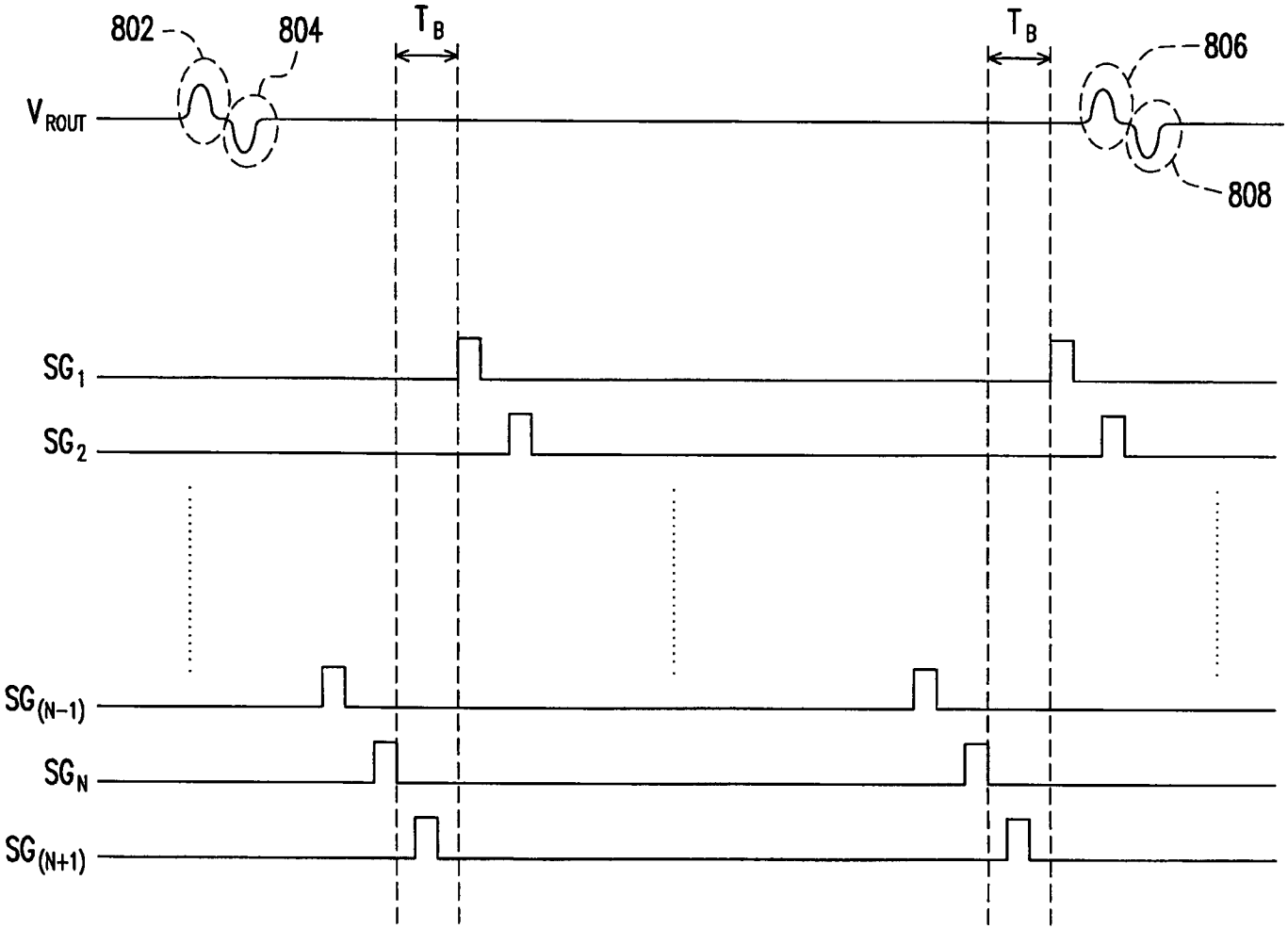
FIG. 8 illustrates a relationship between the inducing signal level and the gate line signals $SG_1$-$SG_{(N+1)}$ on one of the inducing signal readout lines in FIG. 7.

FIG. 8 illustrates a relationship between the inducing signal level and the gate line signals $SG_1$-$SG_{(N+1)}$ on one of the inducing signal readout lines in FIG. 7. Referring to FIG. 8, the inducing signal level on the inducing signal readout line is denoted by $V_{ROUT}$. $SG_1$-$SG_{(N+1)}$ and $T_B$ denote the same as those in FIG. 7. During the blanking time $T_B$, although the gate line signals $SG_1$-$SG_N$ are in a low level state, but the gate line signal $SG_{(N+1)}$ is in a high level state, so the inducing circuits 710 to which the gate line $G_{(N+1)}$ is coupled continuously output a constant inducing signal, such that the inducing signal level $V_{ROUT}$ on the inducing signal readout line remains at a stable level. Therefore, the overall induction sensitivity of the panel is very uniform no matter the case denoted by 802 or 804 or the case denoted by 806 or 808 occurs.

Definitely, if the duration of the blanking time $T_B$ is too long, the user can also extend the pulse width of the gate pulse of the gate line signal $SG_{(N+1)}$ to fill the whole blanking time $T_B$. If it is not intended to increase the pulse width of the gate pulse, a plurality of gate pulses is used to drive the gate lines $G_{(N+1)}$ during the blanking time $T_B$. Or, more dummy gate lines are added in the display panel 702, and the dummy gate lines are sequentially driven during the blanking time $T_B$ with reference to the manner of the dummy gate line $G_{(N+1)}$. Further, the dummy gate line $G_{(N+1)}$ may also be driven before driving the gate line $G_N$ and does not need to be driven after the gate line $G_N$ have been driven. Furthermore, the dummy gate line $G_{(N+1)}$ may be placed at any position of the display panel and are not limited to be placed after the gate line $G_N$. It should be noted that if the user adopts the manner in FIG. 7 to solve the problem of non-uniform induction sensitivity, the source driver does not need to change the output manner of the frame data since the dummy gate line $G_{(N+1)}$ does not need to be coupled to the pixel.

Figure 9:
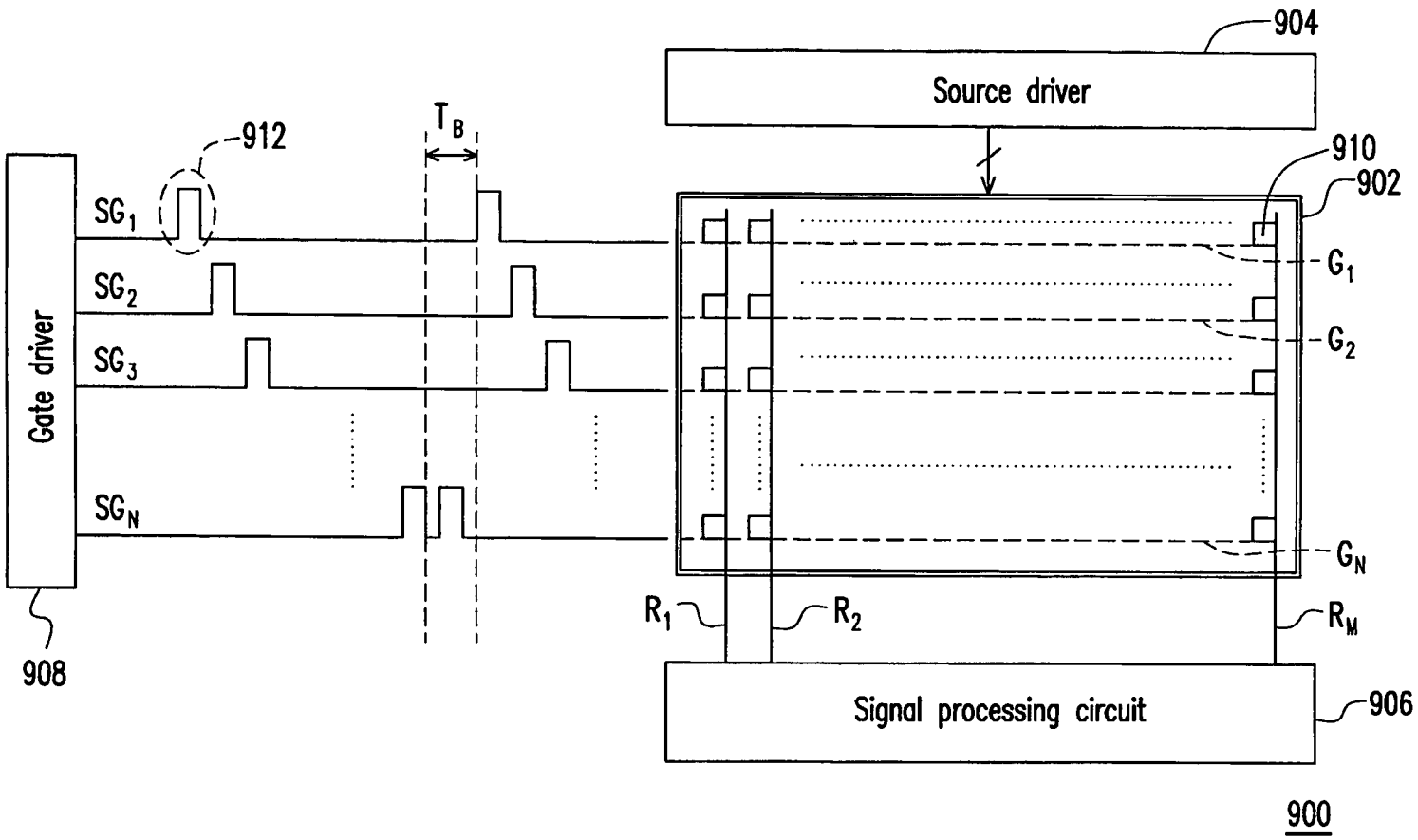
FIG. 9 is a schematic view of a display apparatus and a method for driving a display panel thereof according to still another embodiment of the present invention.

In view of the above embodiments and illustration, two solutions may be further deduced, and one of them is shown in FIG. 9. FIG. 9 is a schematic view of a display apparatus and a method for driving a display panel thereof according to still another embodiment of the present invention. Referring to FIGS. 9 and 5 together, the difference therebetween is described as follows. A gate driver 908 in FIG. 9 does not extend the driving duration of the original gate pulse of the gate line $G_N$ to the blanking time $T_B$, but provides another gate pulse to drive the gate line $G_N$ during the blanking time $T_B$. In detail, the gate driver 908 sequentially drives the gate lines $G_1$-$G_N$ to turn on the corresponding inducing circuits through gate lines, and the gate driver 908 drives the gate line $G_N$ again during the blanking time $T_B$ between two frames to turn on the inducing circuits to which the gate line $G_N$ is coupled during the blanking time $T_B$. Furthermore, in the course of driving the gate line $G_N$ shown in FIG. 9 again, a source driver 904 provides the same frame data to the pixel to which the gate line $G_N$ is coupled, so as to display a normal frame.

Figure 10:
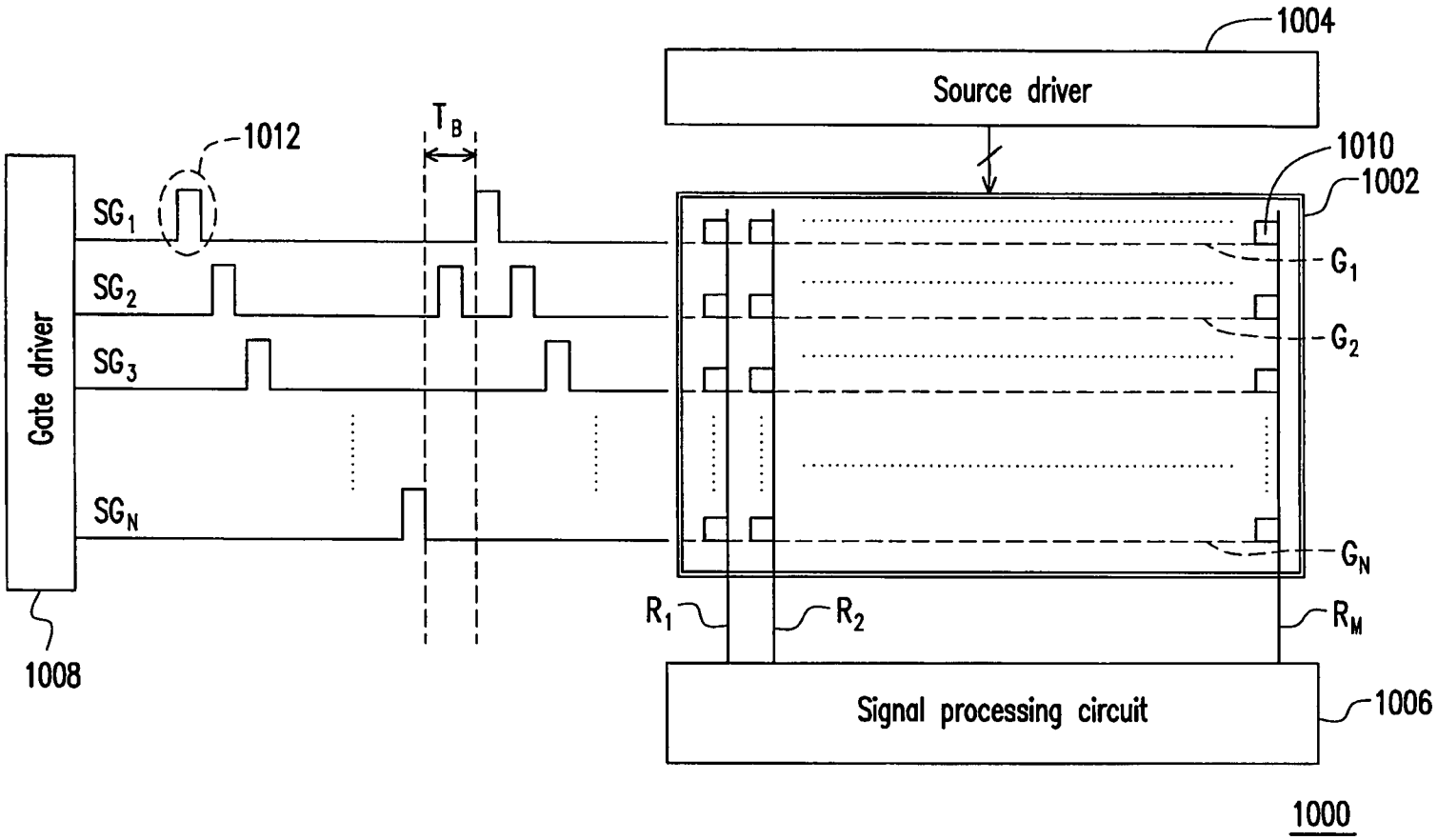
FIG. 10 is a schematic view of a display apparatus a method for driving a display panel thereof according to yet another embodiment of the present invention.

The other solution as shown in FIG. 10 may be deduced. FIG. 10 is a schematic view of a display apparatus and a method for driving a display panel thereof according to yet another embodiment of the present invention. Referring to FIGS. 10 and 9 together, the difference therebetween is described as follows. In the method as shown in FIG. 10, the gate line $G_N$ is not driven again during the blanking time $T_B$, but the gate lines $G_2$ is driven again during the blanking time $T_B$. In detail, the gate driver 1008 sequentially drives the gate lines $G_1$-$G_N$ to turn on the corresponding inducing circuits through the gate lines and the gate driver 1008 drives the gate lines $G_2$ again during the blanking time $T_B$ between two frames to turn on the inducing circuits to which the gate lines $G_2$ is coupled through the gate lines $G_2$ during the blanking time $T_B$. Definitely, during the blanking time $T_B$, any one of the gate lines $G_1$-$G_N$, but not limited to, the gate lines $G_2$ may be optionally driven again.

According to the teachings of the above embodiments, those skilled in the art should know that, the display panel is not limited to the embedded input panel. Further, a variety of display panels, for example, light input display panel, can also be implemented according to the above applications, so as to achieve the purpose of uniformizing the induction sensitivity. Definitely, different display panels may have different implementations of the inducing circuits, and the configuration of the inducing circuits made by different manufacturers differs. For example, some manufacturers may arrange one inducing circuit at an interval of several gate lines. However, the present invention is applicable as long as several inducing circuits share one inducing signal readout line.

In view of above, the present invention extend the driving duration of the last gate lines to the blanking time between two frames to turn on the inducing circuits to which the last gate line is coupled through the last gate line during the blanking time. Or, an additional dummy gate line is added in the display panel, and the dummy gate line is driven during the blanking time to turn on the inducing circuits to which the dummy gate line is coupled through the dummy gate line during the blanking time. Even, one of the gate lines is driven again during the blanking time, as long as the gate line to be driven again is coupled to the inducing circuit. Therefore, the inducing signal on the inducing signal readout line is always maintained at a substantially stable level, thus not affecting the identification accuracy of the first several gate lines of the next frame, and further making the induction sensitivity of the display panel more uniform.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for driving a display panel, wherein the display panel comprises an inducing signal readout line and N gate lines, N is a natural number, the inducing signal readout line is coupled to a plurality of inducing circuits, each inducing circuit is coupled to one of the gate lines, and the $N^{th}$ gate line is coupled to one of the inducing circuits, comprising:

providing several gate pulses to drive the gate lines sequentially to turn on the corresponding inducing circuits; and wherein at least a portion of driving duration of a gate pulse only provided to the $N^{th}$ gate line is in a blanking time between two frames and fully overlaps the entire blanking time, so as to make a level of an inducing signal on the inducing signal readout line remain at a stable level during the entire blanking time, wherein only a single pulse among all the gate lines is applied during the entire blanking time, wherein a pulse stop time of the gate pulse only provided to the $N^{th}$ gate line is an ending of the blanking time between the two frames.

2. The method for driving a display panel as claimed in claim 1, wherein the gate pulse provided to the $N^{th}$ gate line is fully within the blanking time between the two frames.

3. The method for driving a display panel as claimed in claim 1, wherein each frame is driven from a $1^{st}$ gate line, and the $N^{th}$ gate line is a last gate line that is driven.

4. The method for driving a display panel thereof as claimed in claim 1, wherein each frame is driven from the $N^{th}$ gate line, and the $1^{st}$ gate line is the last gate line that is driven.

5. The method for driving a display panel as claimed in claim 1, wherein the display panel is an embedded input panel.

6. The method for driving a display panel as claimed in claim 5, wherein the inducing circuits comprise charge inducing circuits or current inducing circuits.

7. The method for driving a display panel as claimed in claim 1, further comprising making the driving duration of the gate pulse provided to the $N^{th}$ gate line extend to the driving duration of an adjacent frame.

8. A display apparatus, comprising:

a display panel, comprising:

N gate lines, wherein N is a natural number;

an inducing signal readout line; and a plurality of inducing circuits, wherein each inducing circuit is coupled to the inducing signal readout line and is coupled to one of the gate lines, and an $N^{th}$ gate line is coupled to one of the inducing circuits; and a gate driver, for providing several gate pulses to drive the gate lines sequentially to turn on the corresponding inducing circuits, and wherein at least a portion of driving duration of a first gate pulse only provided to the $N^{th}$ gate line is in a blanking time between two frames and fully overlaps the entire blanking time, so as to make a level of an inducing signal on the inducing signal readout line remain at a stable level during the entire blanking time, wherein only a single pulse among all the gate lines is applied during the entire blanking time, wherein a pulse stop time of the gate pulse only provided to the $N^{th}$ gate line is an ending of the blanking time between the two frames.

9. The display apparatus as claimed in claim 8, wherein the first gate pulse provided to the $N^{th}$ gate line is fully within the blanking time between the two frames.

10. The display apparatus as claimed in claim 8, further comprising providing a second gate pulse to the $N^{th}$ gate line before the first gate pulse is provided.

11. The display apparatus as claimed in claim 8, wherein each frame is driven from a $1^{st}$ gate line, and the $N^{th}$ gate line is a last gate line that is driven.

12. The display apparatus as claimed in claim 8, wherein each frame is driven from the Nth gate line, and the $1^{st}$ gate line is the last gate line that is driven.

13. The display apparatus as claimed in claim 8, wherein the display panel is an embedded input panel.

14. The display apparatus as claimed in claim 13, wherein the inducing circuits comprise charge inducing circuits or current inducing circuits.

15. The display apparatus as claimed in claim 8, further comprising making the driving duration of the first gate pulse provided to the $N^{th}$ gate line extend to the driving duration of an adjacent frame.

* * * * *